US009431717B1

(12) United States Patent
Lee et al.

(10) Patent No.: US 9,431,717 B1
(45) Date of Patent: Aug. 30, 2016

(54) WIDEBAND DUAL-ARM ANTENNA WITH PARASITIC ELEMENT

(71) Applicant: AMAZON TECHNOLOGIES, INC., Reno, NV (US)

(72) Inventors: Tzung-I Lee, San Jose, CA (US); In Chul Hyun, San Jose, CA (US); Adrian Napoles, Cupertino, CA (US)

(73) Assignee: Amazon Technologies, Inc., Reno, NV (US)

( * ) Notice: Subject to any disclaimer, the term of this patent is extended or adjusted under 35 U.S.C. 154(b) by 475 days.

(21) Appl. No.: 13/926,873

(22) Filed: Jun. 25, 2013

(51) Int. Cl.
*H01Q 1/24* (2006.01)
*H01Q 19/00* (2006.01)

(52) U.S. Cl.
CPC ..... *H01Q 19/005* (2013.01)

(58) Field of Classification Search
USPC ..... 343/700 MS, 702, 829, 846
See application file for complete search history.

(56) References Cited

U.S. PATENT DOCUMENTS

| | | | | |
|---|---|---|---|---|
| 6,456,249 | B1 * | 9/2002 | Johnson | H01Q 1/243 343/700 MS |
| 7,050,010 | B2 * | 5/2006 | Wang | H01Q 1/22 343/700 MS |
| 7,256,743 | B2 * | 8/2007 | Korva | H01Q 1/244 343/702 |
| 7,518,555 | B2 * | 4/2009 | Heng | H01Q 9/42 343/700 MS |
| 8,957,827 | B1 * | 2/2015 | Lee | H01Q 5/321 343/700 MS |
| 9,002,262 | B1 * | 4/2015 | Kuo | H01Q 1/50 343/702 |

* cited by examiner

*Primary Examiner* — Tho G Phan
(74) *Attorney, Agent, or Firm* — Lowenstein Sandler LLP

(57) ABSTRACT

Antenna structures and methods of operating the same of a wideband dual-arm antenna of an electronic device are described. One wideband antenna includes a first feeding arm coupled to a radio frequency (RF) feed and a second feeding arm coupled to the RF feed. At least a portion of the second feeding arm is parallel to the first feeding arm. The wideband dual-arm antenna further includes a third arm coupled to the ground plane. The third arm is a parasitic ground element that forms a coupling to the first feeding arm and the second feeding arm. The parasitic element increases a bandwidth of the wideband antenna.

20 Claims, 8 Drawing Sheets

WIDEBAND DUAL-ARM ANTENNA WITH PARASITIC ELEMENT

BACKGROUND

A large and growing population of users is enjoying entertainment through the consumption of digital media items, such as music, movies, images, electronic books, and so on. The users employ various electronic devices to consume such media items. Among these electronic devices (referred to herein as user devices) are electronic book readers, cellular telephones, personal digital assistants (PDAs), portable media players, tablet computers, netbooks, laptops and the like. These electronic devices wirelessly communicate with a communications infrastructure to enable the consumption of the digital media items. In order to wirelessly communicate with other devices, these electronic devices include one or more antennas.

The conventional antenna usually has only one resonant mode in the lower frequency band and one resonant mode in the high-band. One resonant mode in the lower frequency band and one resonant mode in the high-band may be sufficient to cover the required frequency band in some scenarios, such as in 3G applications. 3G, or 3rd generation mobile telecommunication, is a generation of standards for mobile phones and mobile telecommunication services fulfilling the International Mobile Telecommunications-2000 (IMT-2000) specifications by the International Telecommunication Union.

BRIEF DESCRIPTION OF THE DRAWINGS

The present inventions will be understood more fully from the detailed description given below and from the accompanying drawings of various embodiments of the present invention, which, however, should not be taken to limit the present invention to the specific embodiments, but are for explanation and understanding only.

DETAILED DESCRIPTION

Antenna structures and methods of operating the same of a wideband dual-arm antenna of an electronic device are described. One wideband antenna includes a first feeding arm coupled to a radio frequency (RF) feed and a second feeding arm coupled to the RF feed. At least a portion of the second feeding arm is parallel to the first feeding arm. The wideband dual-arm antenna further includes a third arm coupled to the ground plane. The third arm is a parasitic ground element that forms a coupling to the first feeding arm and the second feeding arm. The parasitic element increases a bandwidth of the wideband antenna. Another wideband dual-arm antenna further includes a grounding line coupled to the ground plane to electrically short the first feeding arm to the ground plane to form an inverted-F antenna (IFA). The wideband dual-arm antenna can be used in a compact single-feed configuration in various portable electronic devices, such as a tablet computer, mobile phones, personal data assistances, electronic readers (e-readers), or the like. In a single-feed antenna, both bandwidth and efficiency in the high-band can be limited by the space availability and coupling between the high-band antenna and the low-band antenna in a compact electronic device. The wideband dual-arm antenna can be used to improve radiation efficiency in desired frequency bands.

The wideband dual-arm antenna can be used for wide band performance for Long Term Evolution (LTE) frequency bands, third generation (3G) frequency bands, or the like. In one implementation, the wideband dual-arm antenna can be configured to operate with multiple resonances in the 3G/LTE frequency bands.

The electronic device (also referred to herein as user device) may be any content rendering device that includes a wireless modem for connecting the user device to a network. Examples of such electronic devices include electronic book readers, portable digital assistants, mobile phones, laptop computers, portable media players, tablet computers, cameras, video cameras, netbooks, notebooks, desktop computers, gaming consoles, DVD players, media centers, and the like. The user device may connect to a network to obtain content from a server computing system (e.g., an item providing system) or to perform other activities. The user device may connect to one or more different types of cellular networks.

Figure 1:
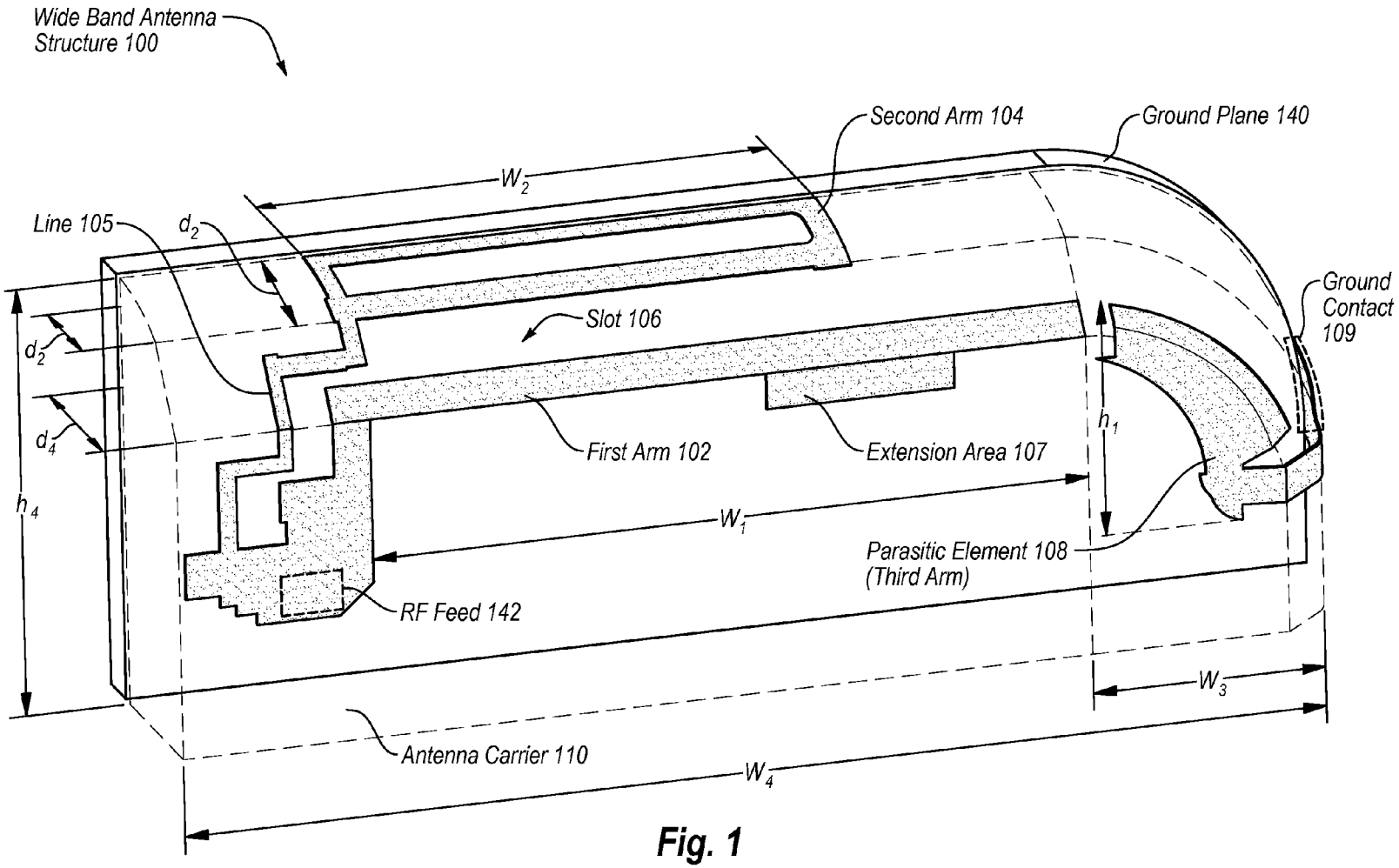
FIG. 1 is a perspective view of a wideband dual-arm antenna according to one embodiment.

FIG. 1 is a perspective view of a wideband dual-arm antenna 100 according to one embodiment. The wideband dual-arm antenna 100 can be disposed in an electronic device that includes circuitry that drives a single radiation frequency (RF) feed 142. In FIG. 1, the ground is represented as a radiation ground plane 140. The ground plane 140 may be a metal frame of the electronic device. The ground plane 140 may be a system ground or one of multiple grounds of the user device. The RF feed 142 may be a feed line connector that couples the wideband dual-arm antenna 100 to a respective transmission line of the electronic device. The RF feed 142 is a physical connection that carries the RF signals to and/or from the wideband dual-arm antenna 100. The feed line connector may be any one of the three common types of feed lines, including coaxial feed lines, twin-lead lines or waveguides. A waveguide, in particular, is a hollow metallic conductor with a circular or square cross-section, in which the RF signal travels along the inside of the hollow metallic conductor. Alternatively, other types of connectors can be used. In the depicted embodiment, the feed line connector is directly connected to the wideband dual-arm antenna 100. In another embodiment, the feed line connection is connected to the wideband dual-arm antenna with an impedance matching network. The RF feed 142 is coupled to the wideband dual-arm antenna 100 at a first end of the wideband dual-arm antenna 100.

In one embodiment, the wideband dual-arm antenna 100 is disposed on an antenna carrier 110, such as a dielectric carrier of the electronic device. The antenna carrier 110 may be any non-conductive material, such as dielectric material, upon which the conductive material of the wideband dual-arm antenna 100 can be disposed without making electrical contact with other metal of the electronic device. In another embodiment, the wideband dual-arm antenna 100 is disposed on, within, or in connection with a circuit board, such as a printed circuit board (PCB). In one embodiment, the ground plane 140 may be a metal chassis of a circuit board. Alternatively, the wideband dual-arm antenna 100 may be disposed on other components of the electronic device or within the electronic device as would be appreciated by one of ordinary skill in the art having the benefit of this disclosure. It should be noted that the wideband dual-arm antenna 100 illustrated in FIG. 1 is a three-dimensional (3D) structure. However, as described herein, the wideband dual-arm antenna 100 may include two-dimensional (2D) structures, as well as other variations than those depicted in FIG. 1.

The wideband dual-arm antenna 100 includes a first feeding arm 102, a second feeding arm 104, and a third arm 108. The third arm 108 is a parasitic element and is referred to hereinafter as the parasitic element 108. An RF feed 142 is coupled to a first end of the wideband dual-arm antenna 100. In particular, the RF feed 142 is coupled to a first end of the first feeding arm 102. The first feeding arm 102 may be formed by one or more conductive traces. For example, a first portion of the first feeding arm 102 extends in a first direction from the RF feed 142 until a first fold and a second portion extends from the first fold in a second direction. It should be noted that a "fold" refers to a bend, a corner or other change in direction of the antenna element. For example, the fold may be where one segment of an antenna element changes direction in the same plane or in a different plane. Typically, folds in antennas can be used to fit the entire length of the antenna within a smaller area or smaller volume of a user device. The RF feed 142 is also coupled to a first end of the second feeding arm 104. The second feeding arm 104 may be formed by one or more conductive traces. For example, a line 105 is coupled to the RF feed and a third portion is coupled to the line and extends in the second direction. The third portion is parallel to the second portion of the first feeding arm 102. In one embodiment, the second feeding arm 104 is parallel to the first feeding arm 102 in its entirety and does not include any portion that is perpendicular to corresponding portions of the first feeding arm 102. In other embodiments, some portions of the second feeding arm 104 are parallel to corresponding portions of the first feeding arm 102. In the depicted embodiment, the third portion of the second feeding arm 104 that is folded onto a second side of the antenna carrier 110. In one embodiment, the first feeding arm 102 is disposed on a first plane on a first side of the antenna carrier 110 (e.g., a front side) and one or more portions of the second feeding arm 104, the parasitic element 108, or of both are disposed on one or more additional planes, such as on a second side of the antenna carrier (e.g., a top side). This can be done to fit the wideband dual-arm antenna structure in a smaller volume while maintaining the overall length of the second feeding arm 104 or other portions of the antenna structure.

The parasitic element 108 includes a fourth portion coupled to a ground contact 109, which is coupled to the ground plane 140. The fourth portion extends from the ground contact 109 and forms a gap between a distal end of the second portion of the first feeding arm 102, the distal end being the farthest from the RF feed 142. That is the fourth portion is disposed to form a gap between a distal end of the first feeding arm 102, the distal end being an end of the first feeding arm 102 that is farthest from the RF feed 142. The proximity of the parasitic element 108 to the distal end forms a coupling between the parasitic element 108 and the first feeding arm 102. When driven by the RF feed 142, the first feeding arm 102 parasitically induces current on the parasitic element 108 that is coupled to the ground plane 104. Although there is a gap between the conductive traces, the parasitic element 108 is in close enough proximity to form a close coupling (also referred to herein as "coupling"), such as a capacitive coupling or an inductive coupling, between the parasitic element 108 and the dual-arm antenna element (e.g., first feeding arm 102 and second feeding arm 104). The presence of the parasitic element 108 can change the first feeding arm 102, which is a monopole antenna, into a coupled monopole antenna. A parasitic element is an element of the wideband dual-arm antenna 100 that is not driven directly by the single RF feed 142. Rather, the single RF feed 142 directly drives another element of the wideband dual-arm antenna 100 (e.g., the first feeding arm 102 and second feeding arm 104), which parasitically induces a current on the parasitic element 108. In particular, by directly applying current on the other element by the single RF feed 142, the directly-fed element radiates electromagnetic energy, which induces another current on the parasitic element to also radiate electromagnetic energy. In the depicted embodiment, the parasitic element 108 is parasitic because it is physically separated from the first feeding arm 102 and the second feeding arm 104, which are driven at the single RF feed 142, but the parasitic element 108 forms a coupling between these antenna elements. For example, the first feeding arm 102 (and/or second feeding arm 104) parasitically excites the current flow of the parasitic element 108. By coupling the driven element and the passive element, additional resonant modes can be created or existing resonant modes can be improved, such as decreasing the reflection coefficient or extending the bandwidth. The depicted antenna structure 100 can use two resonant modes to cover a range of about 1.7 GHz to about 2.7 GHz. In other embodiments, additional resonant modes can be achieved. Also, in other embodiments, the frequency range may be between approximately 1.7 GHz and approximately 6 GHz. In another embodiment, the antenna structure can be tuned to operate at approximately 3.5 GHz.

In another embodiment, a tunable element (not illustrated) is coupled between the ground contact 109 and the ground plane 140. The tunable element can be used to tune the resonant frequency of the parasitic element 108.

The second feeding arm 104 is disposed to form a slot 106 between the second feeding arm 104 and the first feeding arm 102. In the depicted embodiment, the second feeding arm 104 also includes an opening (not labeled) in the middle of the third portion. The opening in the middle of the third portion can be used to accommodate other components of the user device, such as a speaker or a microphone. In another embodiment, the third portion can be continuous conductive material and not have an opening as illustrated. The line 105 may be a meandering line that follows the upper perimeter of the first feeding arm 102. The meandering line can be disposed to be parallel to the corresponding folds and bends of the first and second portions of the first arm 102. The slot 106 between the first feeding arm 102 and the second feeding arm 104 can be carefully designed to achieve the wide bandwidth as described herein. The first feeding arm 102 contributes to resonance frequencies of a first resonant mode (low-band), the parasitic element 108 contributes to resonance frequencies of a second resonant mode (high-band) and the second feeding arm 104 expands a bandwidth between the first resonant mode and the second resonant mode. That is, the second feeding arm 104 increases efficiency of the resonance frequencies of the first resonant mode and second resonant mode to expand the bandwidth of the antenna structure 100. For example, the antenna structure 100 can be configured to operate in a frequency range of approximately 1.7 GHz to approximately 2.7 GHz, and the second feeding arm 104 is disposed to form the slot 106, which expands the bandwidth between about 1.7 GHz and about 2.7 GHz. The parasitic element 108 may also contribute to impedance matching of the low-band (e.g., about 1.7 GHz) of the first feeding arm 102. For another example, the antenna structure 100 can be configured to operate in a frequency range of approximately 1.7 GHz to approximately 3.5 GHz, and the second feeding arm 104 is disposed to form the slot 106, which expands the bandwidth between about 1.7 GHz and about 3.5 GHz. The parasitic element 108 may also contribute to impedance matching of the low-band (e.g., about 1.7 GHz) of the first feeding arm 102. In another embodiment, the antenna structure 100 can be configured to operate in a frequency range of approximately 1.7 Ghz to approximately 6 GHz.

The dimensions of the wideband dual-arm antenna 100 may be varied to achieve the desired frequency range as would be appreciated by one of ordinary skill in the art having the benefit of this disclosure, however, the total length of the antennas is a major factor for determining the frequency, and the width of the antennas is a factor for impedance matching. It should be noted that the factors of total length and width are dependent on one another. The wideband dual-arm antenna 100 may have various dimensions based on the various design factors. The first feeding arm 102 has a first effective length that is roughly the distance between the RF feed 1420 along the conductive trace(s). In one embodiment, the wideband dual-arm antenna 100 has an overall height ($h_4$), an overall width ($W_4$), and an overall depth ($d_4$). The overall height ($h_4$) may vary, but, in one embodiment, is about 9 mm. The overall width ($W_4$) may vary, but, in one embodiment, is about 30 mm. The overall depth ($d_4$) may vary, but, in one embodiment, is about 5 mm. The first feeding arm 102 has a width ($W_1$) that may vary, but, in one embodiment, 17 X mm. The first feeding arm 102 has a height ($h_1$) that may vary, but, in one embodiment, is 6 mm. The first feeding arm 102 has a first effective length that may vary, but, in one embodiment, is 24 mm. The second feeding arm 104 has a width ($W_2$) that may vary, but, in one embodiment, is 12 mm. The second feeding arm 104 has a height ($h_4$) that may vary, but, in one embodiment, is 9 mm. The second feeding arm 104 has a depth ($d_2$) that may vary, but, in one embodiment, is 4 mm. The second feeding arm 104 has a second effective length that may vary, but, in one embodiment, is 30 mm. The slot 106 has a height (not labeled) that may vary, but, in one embodiment, is 3 mm. The slot 106 has a width (not labeled) that may vary, but, in one embodiment, is 12 mm (e.g., the width of the second arm ($W_2$). The parasitic element 108 has a width ($W_3$) that may vary, but, in one embodiment, is 6 mm. The parasitic element 108 has a height ($h_1$) that may vary, but, in one embodiment, is 6 mm. The parasitic element 108 has a third effective length that may vary, but, in one embodiment, is 12 mm. Alternatively, other dimensions may be used for the antenna structure 100.

In a further embodiment, as illustrated in FIG. 1, the first feeding arm 102 includes an extension area 107. The extension area 107 is coupled to a distal end of the first feeding arm 102, the distal end being an end farthest from the RF feed 142. The extension area 107 contributes to an effective length of the first feeding arm 102. The extension area 107 can be shortened or lengthened to tune the resonance frequencies of the first resonant mode. The extension area 107 can be used to contribute to impedance matching, as well as to increase the close coupling with the parasitic element 108.

Figure 4:
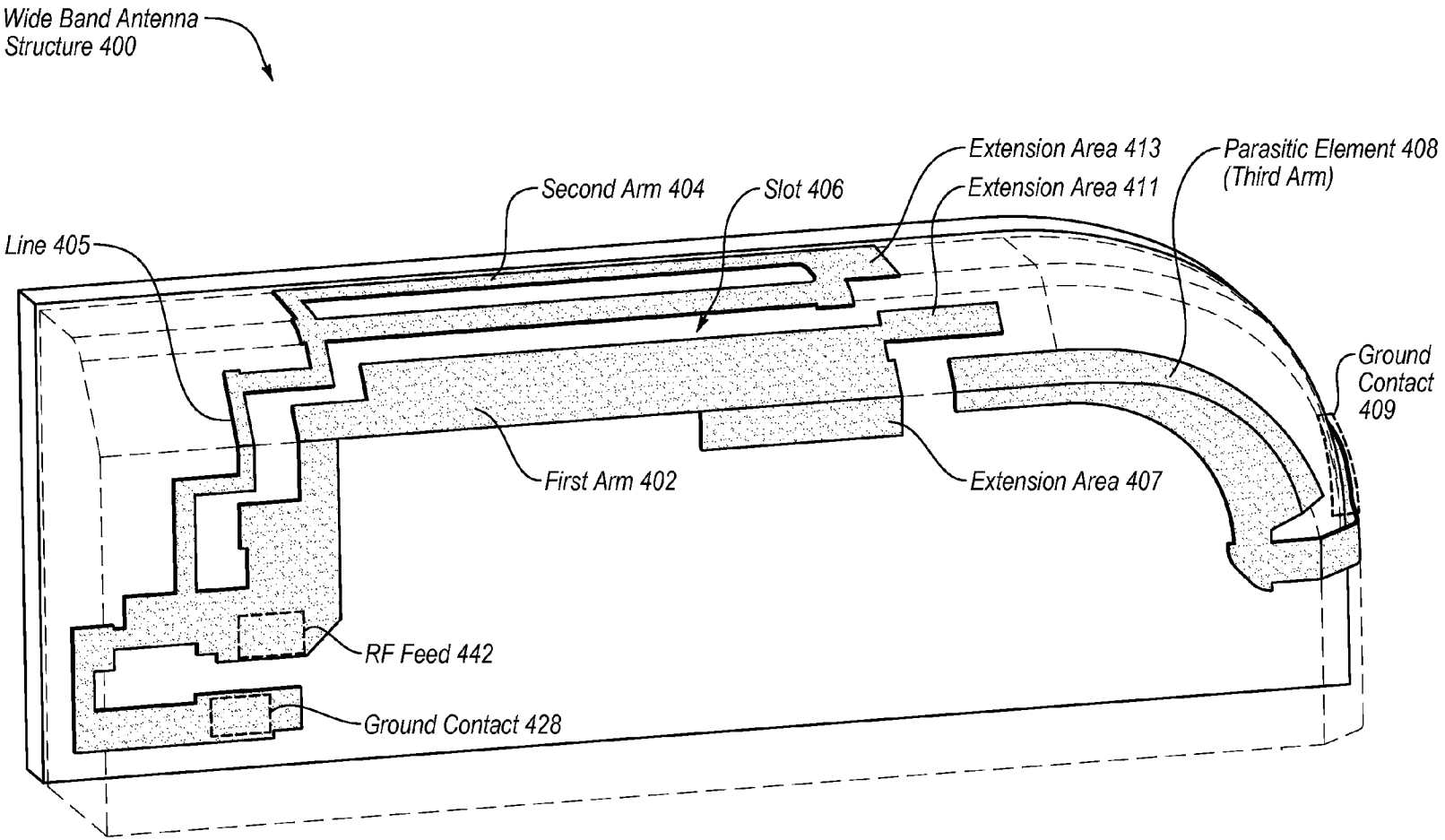
FIG. 4 is a perspective view of a wideband dual-arm antenna according to another embodiment.

In another embodiment, as illustrated in FIG. 4, the first feeding arm includes multiple extension areas. In another embodiment, the wideband dual-arm antenna 100 may include one or more additional arms, slots (not illustrated) or notches (not illustrated) for one or more additional resonant modes.

In this embodiment, the wideband dual-arm antenna 100 is a 3D structure as illustrated in the perspective view of FIG. 1. In other embodiments, the second feeding arm 104 and parasitic element 108 are 3D structures that wrap around different sides of the antenna carrier 110 and the first feeding arm 102 is a 2D structure disposed on a front side of the antenna carrier. Of course, other variations of layout may be used for the first feeding arm 102, second feeding arm 104 and the parasitic element 108. It should also be noted that various shapes for the wideband dual-arm antenna 100 are possible. For example, the wideband dual-arm antenna structure can have various bends, such as to accommodate placement of other components, such as a speakers, microphones, USB ports.

As described herein, strong resonances are not easily achieved within a compact space within user devices, especially within the spaces on smart phones and tablets. The structure of the wideband dual-arm antenna 100 of FIG. 1 provides strong resonances at a first frequency of approximately 1.7 GHz and at a second frequency of approximately 2.7 GHz. Alternatively, the structure of the wideband dual-arm antenna 100 provides strong resonances at other frequency ranges, such as approximately 3.5 GHz or 6 GHz. These resonances can be operated in separate modes or may be operated simultaneously. These multiple strong resonances can provide an improved antenna design as compared to conventional designs. In one embodiment, the wideband dual-arm antenna 100 illustrated in FIG. 1 is configured to radiate electromagnetic energy in a first frequency range (e.g., low-band) and in a second frequency range (e.g., high-band). The second frequency range is higher than the first frequency range. In one embodiment, the wideband dual-arm antenna 100 can operate between the first frequency range and the second frequency range, such as the frequency range between about 1.7 GHz to about 2.7 GHz. In one embodiment, the wideband dual-arm antenna 100 can operate between the first frequency range and the second frequency range, such as the frequency range between about 1.7 GHz to about 3.5 GHz. The embodiments described herein are not limited to use in these frequency ranges, but could be used to increase the bandwidth of a multi-band frequency in other frequency ranges, as described herein. The antenna structure may be configured to operate in multiple resonant modes. For example, in another embodiment, the antenna structure may include one or more additional arm elements, slot antennas in the antenna structure or notches to create one or more additional resonant modes. In another embodiment, the antenna structure may include additional parasitic elements, such as a parasitic ground element (e.g., a monopole that extends from the ground plane that couples to the other antenna elements), to create an additional resonant mode. The embodiments described herein are not limited to use in these frequency ranges, but could be used to increase the bandwidth of a multi-band frequency in other frequency ranges, such as for operating in one or more of the following frequency bands Long Term Evolution (LTE) 700, LTE 2700, Universal Mobile Telecommunications System (UMTS) (also referred to as Wideband Code Division Multiple Access (WCDMA)) and Global System for Mobile Communications (GSM) 850, GSM 900, GSM 1800 (also referred to as Digital Cellular Service (DCS) 1800) and GSM 1900 (also referred to as Personal Communication Service (PCS) 1900). The antenna structure may be configured to operate in multiple resonant modes. References to operating in one or more resonant modes indicates that the characteristics of the antenna structure, such as length, position, width, proximity to other elements, ground, or the like, decrease a reflection coefficient at certain frequencies to create the one or more resonant modes as would be appreciated by one of ordinary skill in the art. Also, some of these characteristics can be modified to tune the frequency response at those resonant modes, such as to extend the bandwidth, increase the return loss, decrease the reflection coefficient, or the like. The embodiments described herein also provide a single-feed antenna with increased bandwidth in a size that is conducive to being used in a user device.

Figure 2:
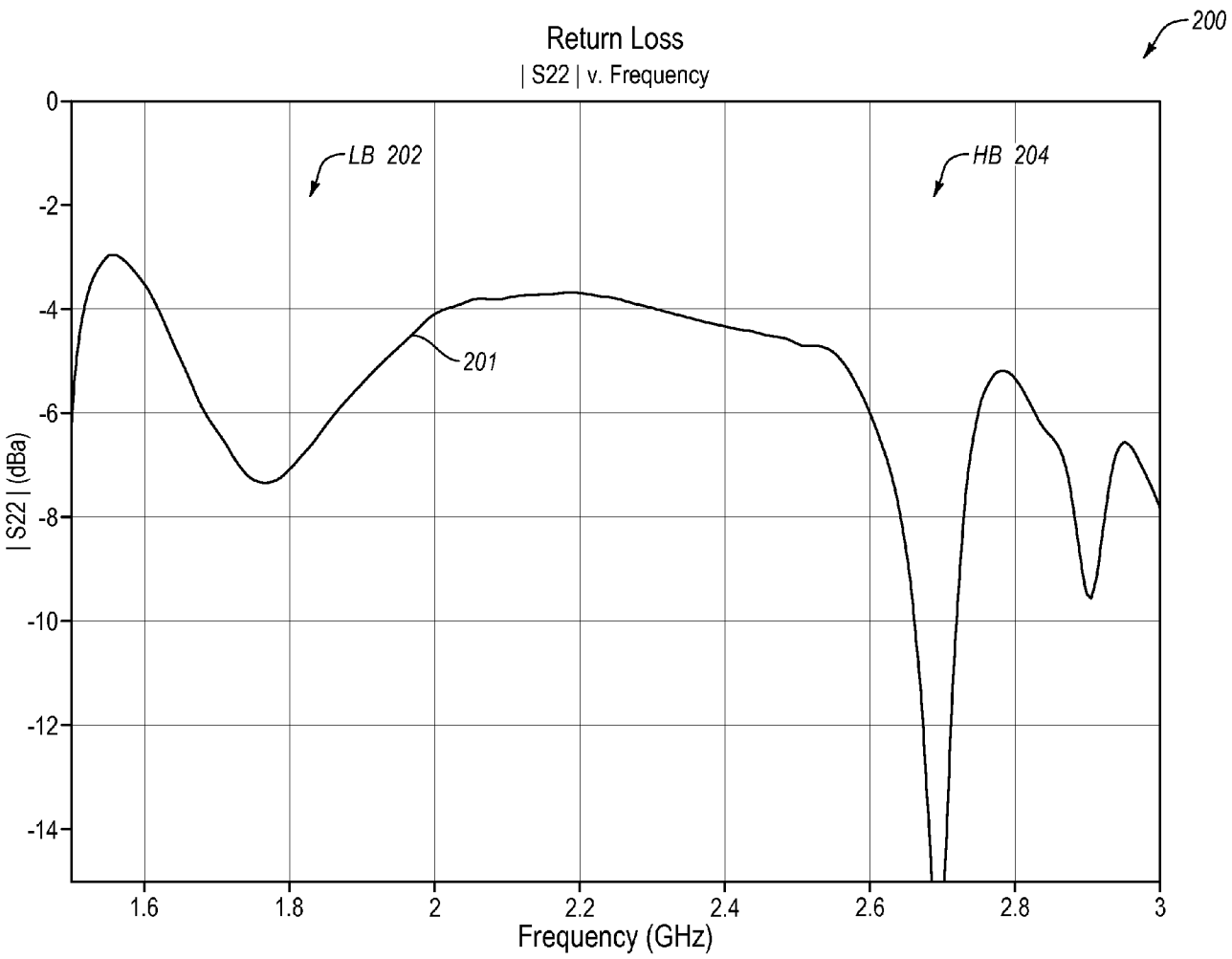
FIG. 2 is a graph of return loss of the wideband dual-arm antenna of FIG. 1 according to one embodiment.

FIG. 2 is a graph 200 of return loss 201 of the wideband dual-arm antenna 100 of FIG. 1 according to one embodiment. The graph 200 shows the return loss 201 (which can also be represented as the S-parameter or measured reflection coefficient or |S11|) of the wideband dual-arm antenna 100 of FIG. 1. The graph 200 illustrates that the wideband dual-arm antenna 100 can be caused to radiate electromagnetic energy between approximately 1.5 GHz to approximately 3 GHz. In the low-band (LB) 202, the wideband dual-arm antenna 100 can operate between approximately 1.5 GHz and approximately 2.2 GHz. In the high-band (HB) 204, the wideband dual-arm antenna 100 can operate between approximately 2.2 GHz to approximately 3 GHz. The wideband dual-arm antenna 100 provides at least three resonant modes, including one in the low-band 202 at approximately 1.75 GHz and two in the high-band 204 at approximately 2.7 GHz and at approximately 2.9 GHz in the high-band 204. As described herein, the wideband antenna 100 can operate between approximately 1.7 GHz and approximately 2.7 GHz. As described herein, other resonant modes may be achieved and the resonant modes may cover different frequency ranges and may be centered at different frequencies than those described and illustrated herein.

In other embodiments, more or less than three resonant modes may be achieved as would be appreciated by one of ordinary skill in the art having the benefit of this disclosure. It should also be noted that the first, second, third, fourth and fifth notations on the resonant modes are not be strictly interpreted to being assigned to a particular frequency, frequency range, or elements of the antenna structure. Rather, the first, second, third, fourth and fifth notations are used for ease of description. However, in some instances, the first, second, third fourth and fifth are used to designate the order from lowest to highest frequencies. Alternatively, other orders may be achieved as would be appreciated by one of ordinary skill in the art having the benefit of this disclosure. In one embodiment, the wideband dual-arm antenna 100 can be configured for the LTE (700/2700), UMTS, GSM (850, 800, 1800 and 1900), GPS and Wi-Fi® and Bluetooth® frequency bands. In another embodiment, the wideband dual-arm antenna 100 can be designed to operate in the following target bands: 1) Verizon LTE band: 746 to 787 MHz; 2) US GSM 850: 824 to 894 MHz; 3) GSM900: 880 to 960 MHz; 4) GSM 1800/DCS: 1.71 to 1.88 GHz; 5) US1900/PCS (band 2): 1.85 to 1.99 GHz; and 6) WCDMA band I (band 1): 1.92 to 2.17 GHz. Alternatively, the wideband dual-arm antenna 100 can be designed to operate in different combinations of frequency bands as would be appreciated by one of ordinary skill in the art having the benefit of this disclosure. Alternatively, the wideband dual-arm antenna 100 can be configured to be tuned to other frequency bands as would be appreciated by one of ordinary skill in the art having the benefit of this disclosure.

The wideband dual-arm antenna 100 can be tuned to be centered at various frequencies, such as, for examples, at approximately 1.77 GHz, at approximately 1.92 GHz or approximately 2.0 GHz. The second frequency range can be tuned to radiate electromagnetic energy in DCS Band 3 when centered at approximately 1.77 GHz, in PCS Band 2 when centered at approximately 1.92 GHz, or in Band 1 when centered at approximately 2.0 GHz. In other embodiments, the second frequency range can be tuned to be centered at other frequencies.

Figure 3:
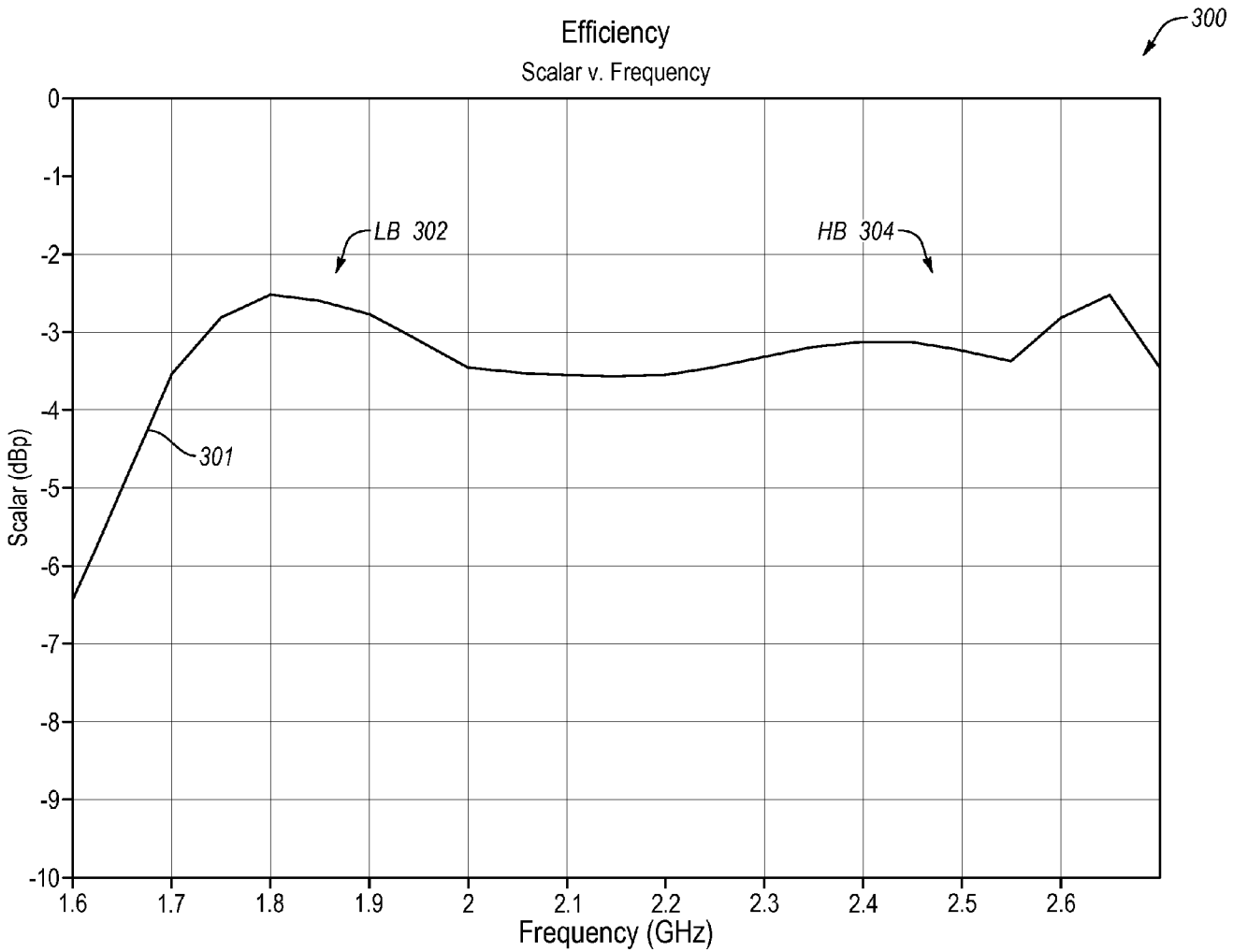
FIG. 3 is a graph of a measured efficiency of the wideband dual-arm antenna of FIG. 1 according to one embodiment.

FIG. 3 is a graph 300 of a measured efficiency of the wideband dual-arm antenna 100 of FIG. 1 according to one embodiment. The graph 300 illustrates the total efficiency 301 over a frequency range in the low-band 302 and over a frequency range in the high-band 304. The graph 300 illustrates that the wideband dual-arm antenna 100 is a viable antenna for the frequency range between approximately 1.7 GHz in the low-band 302 and approximately 2.7 GHz in the high-band 304. In another embodiment, the wideband dual-arm antenna 100 can be configured to operate over the entire frequency range as a high-band and another antenna can be configured to operate in a second frequency range in a low-band.

As would be appreciated by one of ordinary skill in the art having the benefit of this disclosure the total efficiency of the antenna can be measured by including the loss of the structure (e.g., due to mismatch loss), dielectric loss, and radiation loss. The efficiency of the antenna can be tuned for specified target bands. The efficiency of the wideband dual-arm antenna may be modified by adjusting dimensions of the 3D structure, the gaps between the elements of the antenna structure, or any combination thereof. Similarly, 2D structures can be modified in dimensions and gaps between elements to improve the efficiency in certain frequency bands as would be appreciated by one of ordinary skill in the art having the benefit of this disclosure.

FIG. 4 is a perspective view of a wideband dual-arm antenna 400 according to another embodiment. The wideband dual-arm antenna 400 can be disposed in an electronic device that includes circuitry that drives a single RF feed 142. The RF feed 142 is coupled to the wideband dual-arm antenna 400 at a first end of the wideband dual-arm antenna 400. It should be noted that the wideband dual-arm antenna 400 illustrated in FIG. 1 is 3D structure. However, as described herein, the wideband dual-arm antenna 100 may include 2D structures, as well as other variations than those depicted in FIGS. 1 and 4.

The wideband dual-arm antenna 400 includes a first feeding arm 402, a second feeding arm 404, and a third arm 408. The third arm 408 is a parasitic element and is referred to hereinafter as the parasitic element 408. However, the wideband dual-arm antenna 400, unlike wideband dual-arm antenna 100, further includes a groundling line 427 coupled to the ground plane. The grounding line 427 electrically shorts the first feeding arm 402 to the ground plane to form an inverted-F antenna (IFA).

An RF feed 142 is coupled to a first end of the wideband dual-arm antenna 400. In particular, the RF feed 142 is coupled to a first end of the first feeding arm 402. The first feeding arm 402 may be formed by one or more conductive traces. For example, a first portion of the first feeding arm 402 extends in a first direction from the RF feed 142 until a first fold and a second portion extends from the first fold in a second direction. The RF feed 142 is also coupled to a first end of the second feeding arm 404. The second feeding arm 404 may be formed by one or more conductive traces. For example, a line 405 is coupled to the RF feed 142 and a third portion is coupled to the line 405 and extends in the second direction. The third portion is parallel to the second portion of the first feeding arm 402. In the depicted embodiment, the third portion of the second feeding arm 404 that is folded onto a second side of the antenna carrier (not illustrated). In the depicted embodiment, the second feeding arm 404 also includes an opening (not labeled) in the middle of the third portion. The opening in the middle of the third portion can be used to accommodate other components of the user device, such as a speaker or a microphone. In another embodiment, the third portion of the second feeding arm 404 can be continuous conductive material and not have an opening as illustrated. In one embodiment, the first feeding arm 402 is disposed on a first plane on a first side of the antenna carrier (e.g., a front side) and one or more portions of the second feeding arm 404, the parasitic element 408, or of both are disposed on one or more additional planes, such as on a second side of the antenna carrier (e.g., a top side). This can be done to fit the wideband dual-arm antenna structure in a smaller volume while maintaining the overall length of the second feeding arm 404 or other portions of the antenna structure 400.

The parasitic element 408 includes a fourth portion coupled to a ground contact 409, which is coupled to the ground plane. The fourth portion extends from the ground contact 409 and forms a gap between a distal end of the second portion of the first feeding arm 402, the distal end being the farthest from the RF feed 142. Although there is a gap between the conductive traces, the parasitic element 408 is in close enough proximity to form a close coupling, such as a capacitive coupling or an inductive coupling, between the parasitic element 408 and the dual-arm antenna element (e.g., first feeding arm 402 and second feeding arm 404). The presence of the parasitic element 408 can change the first feeding arm 402, which is a monopole antenna, into a coupled monopole antenna. The first feeding arm 402 (and/or second feeding arm 404) parasitically excites the current flow of the parasitic element 408. By coupling the driven element and the passive element, additional resonant modes can be created or existing resonant modes can be improved, such as decreasing the reflection coefficient or extending the bandwidth. The depicted antenna structure 400 can use two resonant modes to cover a range of about 1.7 GHz to about 2.7 GHz. Alternatively, the antenna structure can cover a frequency range of about 1.7 GHz to about 3.5 GHz.

In another embodiment, a tunable element (not illustrated) is coupled between the ground contact 409 and the ground plane. The tunable element can be used to tune the resonant frequency of the parasitic element 408. In another embodiment, a tunable element is coupled between the ground contact 428 and the ground plane. This tunable element can be used to tune the resonant frequency of the first arm 402.

The second feeding arm 404 is disposed to form a slot 406 between the second feeding arm 404 and the first feeding arm 402. The line 405 may be a meandering line that follows the upper perimeter of the first feeding arm 402. The slot 406 between the first feeding arm 402 and the second feeding arm 404 can be carefully designed to achieve the wide bandwidth as described herein. The first feeding arm 402 contributes to resonance frequencies of a first resonant mode (low-band), the parasitic element 408 contributes to resonance frequencies of a second resonant mode (high-band) and the second feeding arm 404 expands a bandwidth between the first resonant mode and the second resonant mode. That is, the second feeding arm 404 increases efficiency of the resonance frequencies of the first resonant mode and second resonant mode to expand the bandwidth of the antenna structure 400. For example, the antenna structure 400 can be configured to operate in a frequency range of approximately 1.7 GHz to approximately 2.7 GHz, and the second feeding arm 404 is disposed to form the slot 406, which expands the bandwidth between about 1.7 GHz and about 2.7 GHz. The parasitic element 408 may also contribute to impedance matching of the low-band (e.g., about 1.7 GHz) of the first feeding arm 402. For another example, the antenna structure 400 can be configured to operate in a frequency range of approximately 1.7 GHz to approximately 3.5 GHz, and the second feeding arm 404 is disposed to form the slot 406, which expands the bandwidth between about 1.7 GHz and about 3.5 GHz. The parasitic element 408 may also contribute to impedance matching of the low-band (e.g., about 1.7 GHz) of the first feeding arm 402.

The dimensions of the wideband dual-arm antenna 100 may be varied to achieve the desired frequency range as would be appreciated by one of ordinary skill in the art having the benefit of this disclosure, however, the total length of the antennas is a major factor for determining the frequency, and the width of the antennas is a factor for impedance matching.

In a further embodiment, as illustrated in FIG. 4, the first feeding arm 402 includes a first extension area 407 coupled to a first side of the second portion of the first feeding arm 402 and a second extension area 411 coupled to a second side of the second portion of the first feeding arm 402. The second extension area 411 is coupled to a distal end of the first feeding arm 402, the distal end being an end farthest from the RF feed 142. The first extension area 407 contributes to an impedance matching of the first feeding arm 402. The second extension area 411 contributes to the impedance matching and an effective length of the first feeding arm 402. The extension area 407 can be used to contribute to impedance matching, as well as to increase the close coupling with the parasitic element 408. The extension area 411 can be used to tune the resonance of the first arm 402 by changing the effective length of the first arm 402. The extension area 411 can also contribute to impedance matching. In a further embodiment, as illustrated in FIG. 4, the second feeding arm 404 includes an extension area 413 coupled to a side of the third portion of the second feeding arm 404. The extension area 413 can be used to contribute to tuning the resonance of the second arm 4024 by changing the effective length of the second arm 404. The extension area 413 can also contribute to impedance matching. In another embodiment, the wideband dual-arm antenna 400 may include one or more additional arms, slots (not illustrated) or notches (not illustrated) for one or more additional resonant modes.

In this embodiment, the wideband dual-arm antenna 400 is a 3D structure as illustrated in the perspective view of FIG. 4. In other embodiments, the second feeding arm 404 and parasitic element 408 are 3D structures that wrap around different sides of the antenna carrier and the first feeding arm 402 is a 2D structure disposed on a front side of the antenna carrier. Of course, other variations of layout may be used for the first feeding arm 402, second feeding arm 404 and the parasitic element 408. It should also be noted that various shapes for the wideband dual-arm antenna 400 are possible. For example, the wideband dual-arm antenna structure can have various bends, such as to accommodate placement of other components, such as a speakers, microphones, USB ports.

As described herein, strong resonances are not easily achieved within a compact space within user devices, especially within the spaces on smart phones and tablets. The structure of the wideband dual-arm antenna 400 of FIG. 4 provides strong resonances at a first frequency of approximately 1.7 GHz and at a second frequency of approximately 2.7 GHz. Alternatively, the structure of the wideband dual-arm antenna 400 provides strong resonances at other frequency ranges, such as between approximately 1.7 GHz and approximately 3.5 GHz. These resonances can be operated in separate modes or may be operated simultaneously. These multiple strong resonances can provide an improved antenna design as compared to conventional designs. In one embodiment, the wideband dual-arm antenna 400 illustrated in FIG. 4 is configured to radiate electromagnetic energy in a first frequency range (e.g., low-band) and in a second frequency range (e.g., high-band). The second frequency range is higher than the first frequency range. In one embodiment, the wideband dual-arm antenna 400 can operate between the first frequency range and the second frequency range, such as the frequency range between about 1.7 GHz to about 2.7 GHz. In one embodiment, the wideband dual-arm antenna 400 can operate between the first frequency range and the second frequency range, such as the frequency range between about 1.7 GHz to about 3.5 GHz. The embodiments described herein are not limited to use in these frequency ranges, but could be used to increase the bandwidth of a multi-band frequency in other frequency ranges, as described herein. The antenna structure may be configured to operate in multiple resonant modes as described herein.

Figure 5:
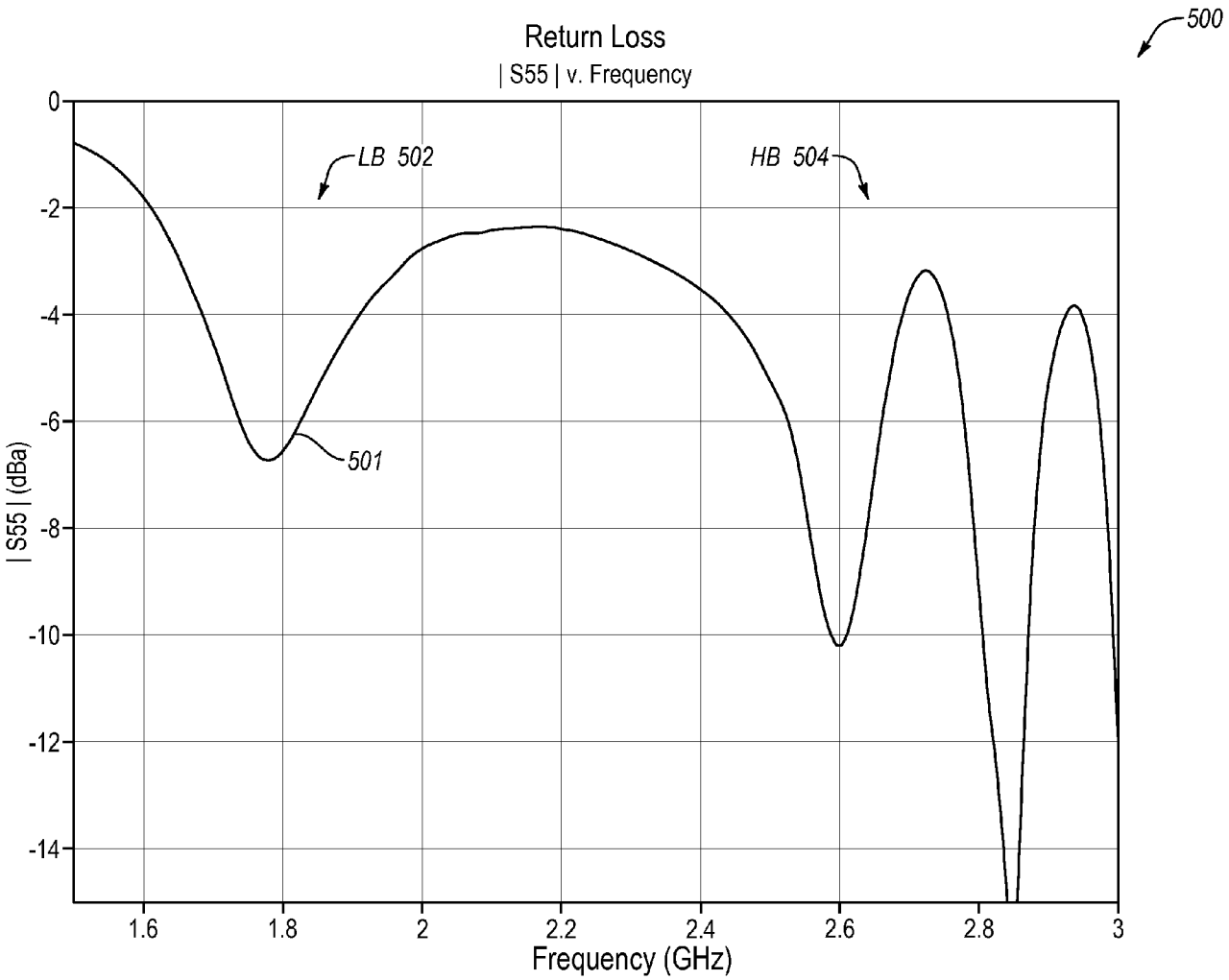
FIG. 5 is a graph of return loss of the wideband dual-arm antenna of FIG. 4 according to one embodiment.

FIG. 5 is a graph of return loss of the wideband dual-arm antenna 400 of FIG. 4 according to one embodiment. The graph 500 shows the return loss 501 of the wideband dual-arm antenna 400 of FIG. 4. The graph 500 illustrates that the wideband dual-arm antenna 400 can be caused to radiate electromagnetic energy between approximately 1.69 GHz to approximately 3 GHz. In the low-band (LB) 502, the wideband dual-arm antenna 100 can operate between approximately 1.69 GHz and approximately 2.2 GHz. In the high-band (HB) 504, the wideband dual-arm antenna 100 can operate between approximately 2.2 GHz to approximately 3 GHz. The wideband dual-arm antenna 400 provides at least four resonant modes, including one in the low-band 502 at approximately 1.75 GHz and three in the high-band 504 at approximately 2.6 GHz, at approximately 2.85 GHz and at approximately 3 GHz in the high-band 504. As described herein, the wideband antenna 400 can operate between approximately 1.7 GHz and approximately 2.7 GHz. As described herein, other resonant modes may be achieved and the resonant modes may cover different frequency ranges and may be centered at different frequencies than those described and illustrated herein.

Figure 6:
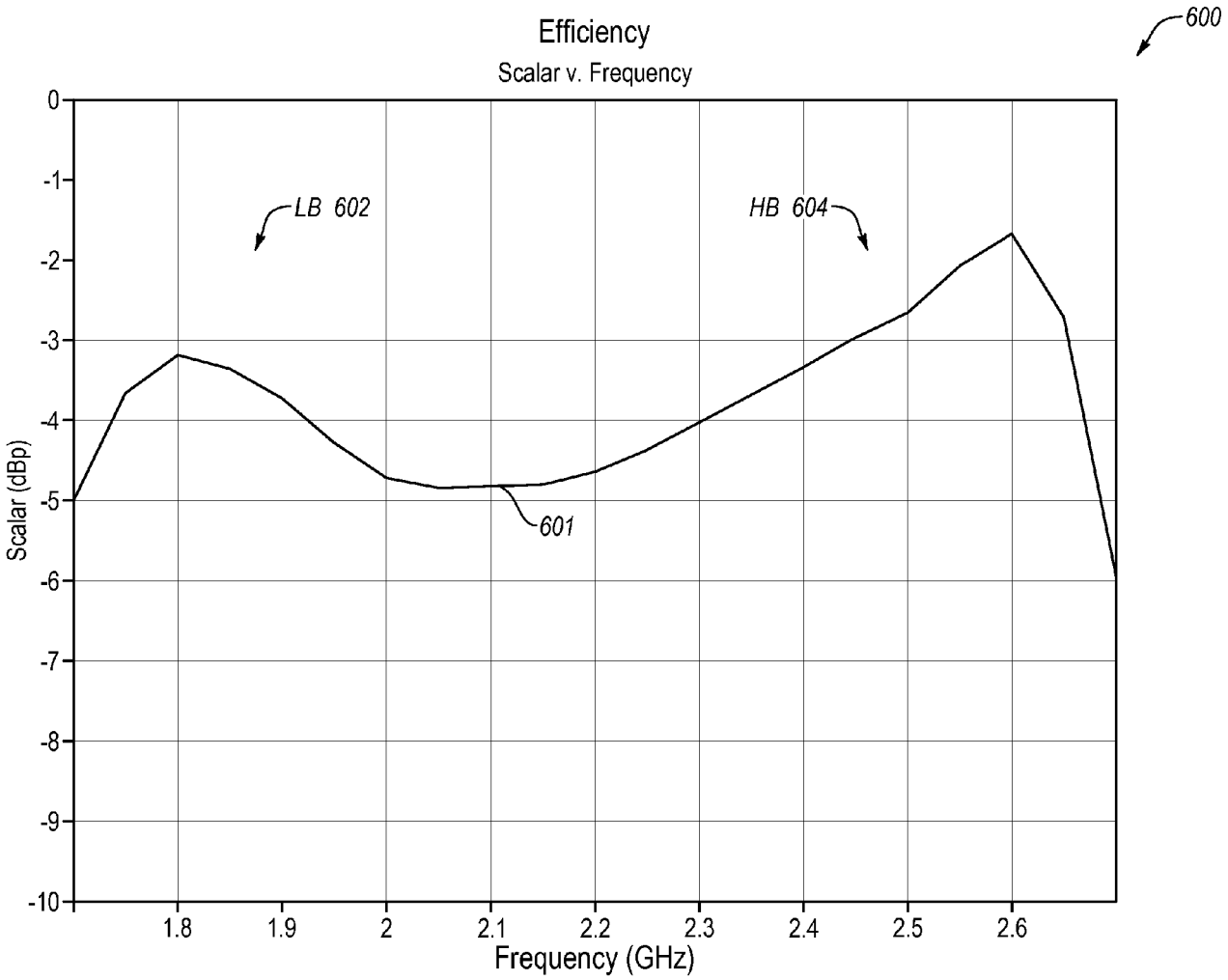
FIG. 6 is a graph of measured efficiency of the wideband dual-arm antenna of FIG. 4 according to one embodiment.

FIG. 6 is a graph 600 of measured efficiency 601 of the wideband dual-arm antenna 400 of FIG. 4 according to one embodiment. The graph 600 illustrates the total efficiency 601 over a frequency range in the low-band 602 and over a frequency range in the high-band 604. The graph 600 illustrates that the wideband dual-arm antenna 400 is a viable antenna for the frequency range between approximately 1.7 GHz in the low-band 602 and approximately 2.7 GHz in the high-band 604. In another embodiment, the wideband dual-arm antenna 400 can be configured to operate over the entire frequency range as a high-band and another antenna can be configured to operate in a second frequency range in a low-band.

Figure 7:
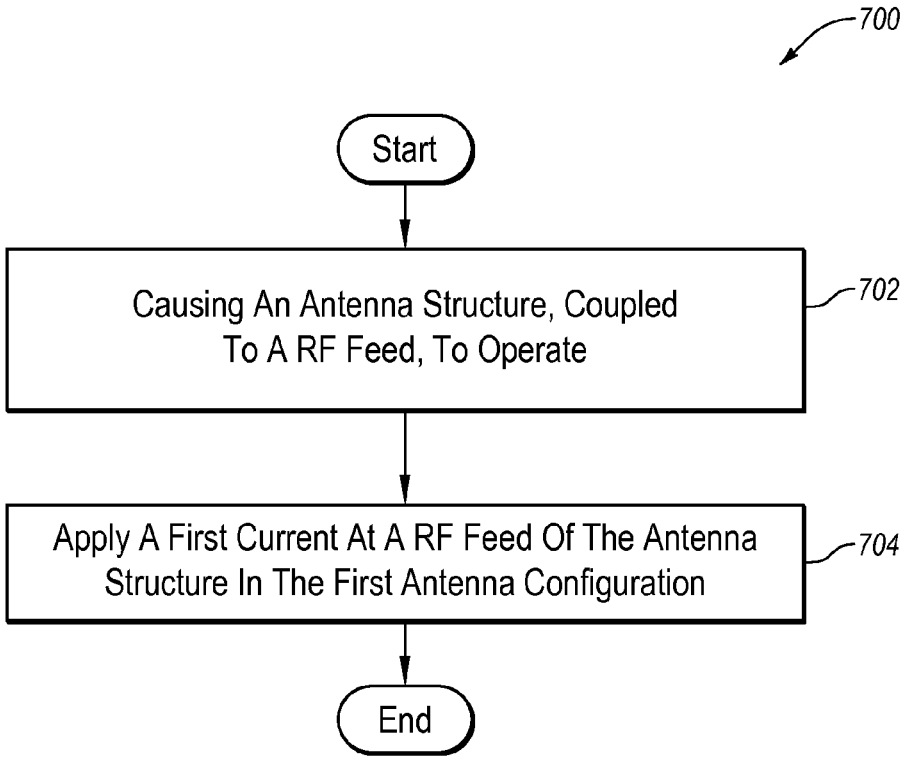
FIG. 7 is a flow diagram of an embodiment of a method of operating a user device having a wideband dual-arm antenna according to one embodiment.

FIG. 7 is a flow diagram of an embodiment of a method 700 of operating an electronic device having a wideband dual-arm antenna according to one embodiment. In method 700, an antenna structure (e.g., wideband dual-arm antenna 100 or 400) is caused to operate (block 702). The antenna structure is coupled to an RF feed. A current is applied to the antenna structure via the RF feed to drive the antenna structure to radiate electromagnetic energy (block 704). In response to applying the first current, electromagnetic energy is radiated from the antenna structure.

In response to the applied current(s), when applicable, the antenna structure radiates electromagnetic energy to communicate information to one or more other devices. Regardless of the antenna configuration, the electromagnetic energy forms a radiation pattern. The radiation pattern may be various shapes as would be appreciated by one of ordinary skill in the art having the benefit of this disclosure.

In a further embodiment, the antenna structure can be tuned with a tunable element coupled between the third arm (parasitic element) and the ground plane. Alternatively, the antenna structure can be tuned with a tunable element coupled between the first arm and the ground plane (e.g., between the ground contact 428 and the ground plane or between the grounding line and the ground contact 428).

The antenna structure of the wideband dual-arm antenna can provide different resonant modes for various bands, such as a low-band, mid-band, high-band, or any combination thereof. For example, the antenna structure provides two resonant modes. In one embodiment, the electromagnetic energy is radiated at a first frequency range of approximately 1.7 GHz to approximately 2.7 GHz. In another embodiment, the electromagnetic energy is radiated at a first frequency range of approximately 1.7 GHz to approximately 3.5 GHz.

Figure 8:
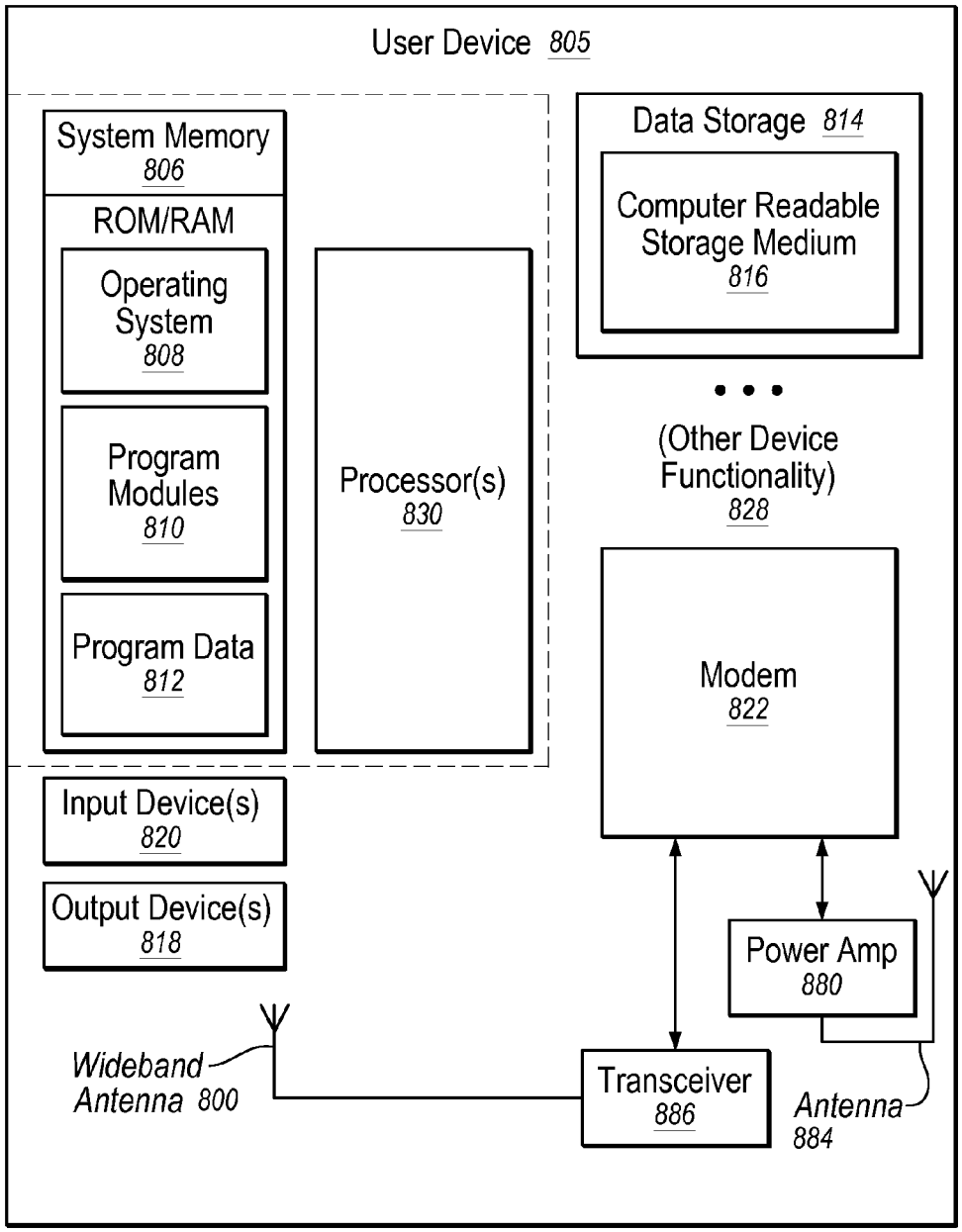
FIG. 8 is a block diagram of a user device having a wideband dual-arm antenna according to one embodiment.

FIG. 8 is a block diagram of a user device 805 having the wideband dual-arm antenna 800 according to one embodiment. The user device 805 includes one or more processors 830, such as one or more CPUs, microcontrollers, field programmable gate arrays, or other types of processing devices. The user device 805 also includes system memory 806, which may correspond to any combination of volatile and/or non-volatile storage mechanisms. The system memory 806 stores information, which provides an operating system component 808, various program modules 810, program data 812, and/or other components. The user device 805 performs functions by using the processor(s) 830 to execute instructions provided by the system memory 806.

The user device 805 also includes a data storage device 814 that may be composed of one or more types of removable storage and/or one or more types of non-removable storage. The data storage device 814 includes a computer-readable storage medium 816 on which is stored one or more sets of instructions embodying any one or more of the functions of the user device 805, as described herein. As shown, instructions may reside, completely or at least partially, within the computer readable storage medium 816, system memory 806 and/or within the processor(s) 830 during execution thereof by the user device 805, the system memory 806 and the processor(s) 830 also constituting computer-readable media. The user device 805 may also include one or more input devices 820 (keyboard, mouse device, specialized selection keys, etc.) and one or more output devices 818 (displays, printers, audio output mechanisms, etc.).

The user device 805 further includes a wireless modem 822 to allow the user device 805 to communicate via a wireless network (e.g., such as provided by a wireless communication system) with other computing devices, such as remote computers, an item providing system, and so forth. The wireless modem 822 allows the user device 805 to handle both voice and non-voice communications (such as communications for text messages, multimedia messages, media downloads, web browsing, etc.) with a wireless communication system. The wireless modem 822 may provide network connectivity using any type of digital mobile network technology including, for example, cellular digital packet data (CDPD), general packet radio service (GPRS), enhanced data rates for GSM evolution (EDGE), UMTS, 1 times radio transmission technology (1×RTT), evaluation data optimized (EVDO), high-speed downlink packet access (HSDPA), WLAN (e.g., Wi-Fi® network), etc. In other embodiments, the wireless modem 822 may communicate according to different communication types (e.g., WCDMA, GSM, LTE, CDMA, WiMax, etc.) in different cellular networks. The cellular network architecture may include multiple cells, where each cell includes a base station configured to communicate with user devices within the cell. These cells may communicate with the user devices 805 using the same frequency, different frequencies, same communication type (e.g., WCDMA, GSM, LTE, CDMA, WiMax, etc), or different communication types. Each of the base stations may be connected to a private, a public network, or both, such as the Internet, a local area network (LAN), a public switched telephone network (PSTN), or the like, to allow the user devices 805 to communicate with other devices, such as other user devices, server computing systems, telephone devices, or the like. In addition to wirelessly connecting to a wireless communication system, the user device 805 may also wirelessly connect with other user devices. For example, user device 805 may form a wireless ad hoc (peer-to-peer) network with another user device.

The wireless modem 822 may generate signals and send these signals to power amplifier (amp) 880 or transceiver 886 for amplification, after which they are wirelessly transmitted via the wideband dual-arm antenna 800 or antenna 884, respectively. Although FIG. 8 illustrates power amp 880 and transceiver 886, in other embodiments, a transceiver may be used for all the antennas 800 and 884 to transmit and receive. Or, power amps can be used for both antennas 800 and 884. The antenna 884, which is an optional antenna that is separate from the wideband dual-arm antenna 800, may be any directional, omnidirectional or non-directional antenna in a different frequency band than the frequency bands of the wideband dual-arm antenna 800. The antenna 884 may also transmit information using different wireless communication protocols than the wideband dual-arm antenna 800. In addition to sending data, the wideband dual-arm antenna 800 and the antenna 884 also receive data, which is sent to wireless modem 822 and transferred to processor(s) 830. It should be noted that, in other embodiments, the user device 805 may include more or less components as illustrated in the block diagram of FIG. 8. In one embodiment, the wideband dual-arm antenna 800 is the wideband dual-arm antenna 100 of FIG. 1. In another embodiment, the wideband dual-arm antenna 800 is the wideband dual-arm antenna 400 of FIG. 4. Alternatively, the wideband dual-arm antenna 800 may be other wideband dual-arm antennas as described herein.

In one embodiment, the user device 805 establishes a first connection using a first wireless communication protocol, and a second connection using a different wireless communication protocol. The first wireless connection and second wireless connection may be active concurrently, for example, if a user device is downloading a media item from a server (e.g., via the first connection) and transferring a file to another user device (e.g., via the second connection) at the same time. Alternatively, the two connections may be active concurrently during a handoff between wireless connections to maintain an active session (e.g., for a telephone conversation). Such a handoff may be performed, for example, between a connection to a WLAN hotspot and a connection to a wireless carrier system. In one embodiment, the first wireless connection is associated with a first resonant mode of the wideband dual-arm antenna 800 that operates at a first frequency band and the second wireless connection is associated with a second resonant mode of the wideband dual-arm antenna 800 that operates at a second frequency band. In another embodiment, the first wireless connection is associated with the wideband dual-arm antenna 800 and the second wireless connection is associated with the antenna 884. In other embodiments, the first wireless connection may be associated with a media purchase application (e.g., for downloading electronic books), while the second wireless connection may be associated with a wireless ad hoc network application. Other applications that may be associated with one of the wireless connections include, for example, a game, a telephony application, an Internet browsing application, a file transfer application, a global positioning system (GPS) application, and so forth.

Though a single modem 822 is shown to control transmission to both antennas 800 and 884, the user device 805 may alternatively include multiple wireless modems, each of which is configured to transmit/receive data via a different antenna and/or wireless transmission protocol. In addition, the user device 805, while illustrated with two antennas 800 and 884, may include more or fewer antennas in various embodiments.

The user device 805 delivers and/or receives items, upgrades, and/or other information via the network. For example, the user device 805 may download or receive items from an item providing system. The item providing system receives various requests, instructions and other data from the user device 805 via the network. The item providing system may include one or more machines (e.g., one or more server computer systems, routers, gateways, etc.) that have processing and storage capabilities to provide the above functionality. Communication between the item providing system and the user device 805 may be enabled via any communication infrastructure. One example of such an infrastructure includes a combination of a wide area network (WAN) and wireless infrastructure, which allows a user to use the user device 805 to purchase items and consume items without being tethered to the item providing system via hardwired links. The wireless infrastructure may be provided by one or multiple wireless communications systems, such as one or more wireless communications systems. One of the wireless communication systems may be a wireless local area network (WLAN) hotspot connected with the network. The WLAN hotspots can be created by Wi-Fi® products based on IEEE 802.11x standards by Wi-Fi Alliance. Another of the wireless communication systems may be a wireless carrier system that can be implemented using various data processing equipment, communication towers, etc. Alternatively, or in addition, the wireless carrier system may rely on satellite technology to exchange information with the user device 805.

The communication infrastructure may also include a communication-enabling system that serves as an intermediary in passing information between the item providing system and the wireless communication system. The communication-enabling system may communicate with the wireless communication system (e.g., a wireless carrier) via a dedicated channel, and may communicate with the item providing system via a non-dedicated communication mechanism, e.g., a public Wide Area Network (WAN) such as the Internet.

The user devices 805 are variously configured with different functionality to enable consumption of one or more types of media items. The media items may be any type of format of digital content, including, for example, electronic texts (e.g., eBooks, electronic magazines, digital newspapers, etc.), digital audio (e.g., music, audible books, etc.), digital video (e.g., movies, television, short clips, etc.), images (e.g., art, photographs, etc.), and multi-media content. The user devices 805 may include any type of content rendering devices such as electronic book readers, portable digital assistants, mobile phones, laptop computers, portable media players, tablet computers, cameras, video cameras, netbooks, notebooks, desktop computers, gaming consoles, DVD players, media centers, and the like.

In the above description, numerous details are set forth. It will be apparent, however, to one of ordinary skill in the art having the benefit of this disclosure, that embodiments may be practiced without these specific details. In some instances, well-known structures and devices are shown in block diagram form, rather than in detail, in order to avoid obscuring the description.

Some portions of the detailed description are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers or the like.

It should be borne in mind, however, that all of these and similar terms are to be associated with the appropriate physical quantities and are merely convenient labels applied to these quantities. Unless specifically stated otherwise as apparent from the above discussion, it is appreciated that throughout the description, discussions utilizing terms such as "inducing," "parasitically inducing," "radiating," "detecting," determining," "generating," "communicating," "receiving," "disabling," or the like, refer to the actions and processes of a computer system, or similar electronic computing device, that manipulates and transforms data represented as physical (e.g., electronic) quantities within the computer system's registers and memories into other data similarly represented as physical quantities within the computer system memories or registers or other such information storage, transmission or display devices.

Embodiments also relate to an apparatus for performing the operations herein. This apparatus may be specially constructed for the required purposes, or it may comprise a general-purpose computer selectively activated or reconfigured by a computer program stored in the computer. Such a computer program may be stored in a computer readable storage medium, such as, but not limited to, any type of disk including floppy disks, optical disks, CD-ROMs and magnetic-optical disks, read-only memories (ROMs), random access memories (RAMs), EPROMs, EEPROMs, magnetic or optical cards, or any type of media suitable for storing electronic instructions.

The algorithms and displays presented herein are not inherently related to any particular computer or other apparatus. Various general-purpose systems may be used with programs in accordance with the teachings herein, or it may prove convenient to construct a more specialized apparatus to perform the required method steps. The required structure for a variety of these systems will appear from the description below. In addition, the present embodiments are not described with reference to any particular programming language. It will be appreciated that a variety of programming languages may be used to implement the teachings of the present invention as described herein. It should also be noted that the terms "when" or the phrase "in response to," as used herein, should be understood to indicate that there may be intervening time, intervening events, or both before the identified operation is performed.

It is to be understood that the above description is intended to be illustrative, and not restrictive. Many other embodiments will be apparent to those of skill in the art upon reading and understanding the above description. The scope of the present embodiments should, therefore, be determined with reference to the appended claims, along with the full scope of equivalents to which such claims are entitled.

What is claimed is:

1. An electronic device comprising:
- a radio frequency (RF) feed; and
- an antenna structure coupled to the RF feed, wherein the antenna structure comprises:
  - a ground plane;
  - a dual-arm antenna element coupled to the RF feed and coupled to the ground plane, wherein the dual-arm antenna element comprises:
    - a first arm coupled to the RF feed, wherein the first arm comprises:
      - a first portion that extends in a first direction from the RF feed until a first fold; and
      - a second portion that extends from the first fold in a second direction; and
    - a second arm coupled to the RF feed, wherein at least a portion of the second arm is parallel to the first arm, wherein the second arm comprises:
    - a line coupled to the RF feed; and
    - a third portion coupled to the line and extends in the second direction, wherein at least some of the third portion is parallel to the second portion of the first arm; and
  - a parasitic element coupled to the ground plane and disposed to form a gap between a distal end of the first arm, the distal end being an end of the first arm farthest from the RF feed, wherein a proximity of the parasitic element to the distal end forms a coupling between the parasitic element and the dual-arm antenna element, wherein the first arm contributes to resonance frequencies of a first resonant mode, the parasitic element contributes to resonance frequencies of a second resonant mode and the second arm increases an efficiency of the resonance frequencies of the first resonant mode and second resonant mode to expand a bandwidth of the antenna structure.

2. The electronic device of claim 1, wherein the dual-arm antenna element further comprises a grounding line coupled to the ground plane, wherein the grounding line electrically shorts the first arm to the ground plane to form an inverted-F antenna (IFA) for the antenna structure.

3. The electronic device of claim 2, wherein the dual-arm antenna element further comprises:

a first extension area coupled to a first side of the second portion of the first arm; and a second extension area coupled to a second side of the second portion of the first arm, wherein the second side is at a distal end of the second portion, the distal end being an end of the second portion that is farthest away from the RF feed, wherein the first extension area contributes to impedance matching of the first arm, and wherein the second extension area contributes to the impedance matching and an effective length of the first arm.

4. The electronic device of claim 1, wherein the dual-arm antenna element further comprises a first extension area coupled to a distal end of the second portion of the first arm, the distal end being an end of the second portion that is farthest away from the RF feed, wherein the first extension area contributes to an effective length of the first arm and impedance matching of the first arm.

5. An apparatus comprising:

a radio frequency (RF) feed; and an antenna structure coupled to the RF feed, wherein the antenna structure comprises:

a ground plane;

a first feeding arm coupled to the RF feed, wherein the first feeding arm comprises:

a first portion that extends in a first direction from the RF feed until a first fold; and a second portion that extends in a second direction from the first fold;

a second feeding arm coupled to the RF feed, wherein at least a portion of the second feeding arm is parallel to the first feeding arm, wherein the second feeding arm comprises:

a line coupled to the RF feed; and a third portion coupled to the line that extends in the second direction, wherein some of the third portion is parallel to the second portion of the first arm; and a third arm coupled to the ground plane, wherein the third arm is a parasitic ground element forming a coupling to the first feeding arm and the second feeding arm.

6. The apparatus of claim 5, wherein the third arm comprises a fourth portion coupled to a ground contact, which is coupled to the ground plane, wherein the fourth portion extends from the ground contact and forms a gap between a distal end of the second portion of the first feeding arm, the distal end being the farthest from the RF feed.

7. The apparatus of claim 5, wherein the antenna structure further comprises a grounding line coupled to the ground plane, wherein the grounding line electrically shorts the first feeding arm to the ground plane to form an inverted-F antenna (IFA).

8. The apparatus of claim 7, wherein the antenna structure further comprises:

a first extension area coupled to a first side of the second portion of the first feeding arm; and a second extension area coupled to a second side of the second portion of the first feeding arm, wherein the second side is at a distal end of the second portion, the distal end being an end of the second portion that is farthest away from the RF feed, wherein the first extension area contributes to impedance matching of the first arm, and wherein the second extension area contributes to the impedance matching and an effective length of the first arm.

9. The apparatus of claim 5, wherein the antenna structure further comprises an extension area coupled to the second portion of the first feeding arm, wherein the extension area contributes to an effective length of the first arm and impedance matching of the first arm.

10. The apparatus of claim 5, wherein the antenna structure is configured to radiate electromagnetic energy in a plurality of resonant modes.

11. The apparatus of claim 10, wherein the plurality of resonant modes operate in a frequency range, wherein the frequency range is approximately 1.7 GHz to approximately 2.7 GHz.

12. The apparatus of claim 10, wherein a first resonant mode of the plurality of resonant modes is at approximately 1.7 GHz and a second resonant mode of the plurality of resonant modes is at approximately 2.7 GHz.

13. The apparatus of claim 12, wherein the second feeding arm increases an efficiency of resonance frequencies of the first resonant mode and second resonant mode to expand a bandwidth of the antenna structure between the first resonant mode and the second resonant mode.

14. The apparatus of claim 13, wherein the first feeding arm contributes to the resonance frequencies of the first resonant mode and the third arm contributes to the resonance frequencies of the second resonant mode.

15. The apparatus of claim 5, wherein the first feeding arm, second feeding arm, and third arm are disposed substantially in a same plane.

16. The apparatus of claim 5, wherein the first feeding arm is disposed on a first plane, and wherein at least a portion of the second feeding arm is disposed on a second plane.

17. The apparatus of claim 5, further comprising a tunable element coupled between the third arm and the ground plane.

18. An apparatus comprising:

a radio frequency (RF) feed; and an antenna structure coupled to the RF feed, wherein the antenna structure comprises:

a ground plane;

a first feeding arm coupled to the RF feed, wherein at least a portion of the first feeding arm extends in a first direction along a first axis from a first point on the first axis towards a distal end of the first feeding arm, the distal end being an end of the first feeding arm farthest from the RF feed;

a second feeding arm coupled to the RF feed, wherein at least a portion of the second feeding arm extends in the first direction along a second axis from a second point on the second axis towards a distal end of the second feeding arm, the distal end of the second feeding arm being an end of the second feeding arm farthest from the RF feed, and the second axis being is parallel to the first axis; and a third arm coupled to the ground plane, wherein the third arm is a parasitic ground element forming a coupling to the first feeding arm and the second feeding arm, wherein a portion of the third arm is disposed to form a gap between the distal end of the first feeding arm and a distal end of the third arm in the first axis, the distal end of the third arm being an end of the third arm farthest away from the RF feed.

19. The apparatus of claim 18, wherein the first feeding arm comprises:

a first portion that extends in a second direction along the first axis from the RF feed until a first fold; and a second portion that extends in the first direction from the first fold, and wherein the second feeding arm comprises:

a line coupled to the RF feed; and a third portion coupled to the line that extends in the second direction along the second axis, wherein some of the third portion is parallel to the second portion of the first arm.

20. The apparatus of claim 18, wherein the antenna structure further comprises a grounding line coupled to the ground plane, wherein the grounding line electrically shorts the first feeding arm to the ground plane to form an inverted-F antenna (IFA).

* * * * *